United States Patent [19]

Mielke

[11] Patent Number: 4,730,812

[45] Date of Patent: Mar. 15, 1988

[54] APPARATUS FOR SHIELDING A MOLTEN METAL STREAM

[75] Inventor: Hans Mielke, Krefeld, Fed. Rep. of Germany

[73] Assignee: Didier-Werke AG, Wiesbaden, Fed. Rep. of Germany

[21] Appl. No.: 666,100

[22] Filed: Oct. 29, 1984

[30] Foreign Application Priority Data

Nov. 22, 1983 [DE] Fed. Rep. of Germany ..... 3342071

[51] Int. Cl.[4] ..... B22D 41/08

[52] U.S. Cl. ..... 266/236; 222/603

[58] Field of Search ..... 266/236, 217, 218, 265, 266/220, 272, 275, 287, 158; 222/605, 606

[56] References Cited

U.S. PATENT DOCUMENTS

| | | | |
|---|---|---|---|
| 3,831,857 | 8/1974 | Scott | 222/603 |
| 4,270,595 | 6/1981 | Coward | 266/217 |
| 4,429,816 | 2/1984 | Thrower | 222/606 |
| 4,480,770 | 11/1984 | Goursat et al. | 222/603 |

FOREIGN PATENT DOCUMENTS

| | | | |
|---|---|---|---|
| 0015251 | 9/1980 | European Pat. Off. | 222/603 |
| 0146458 | 9/1982 | Japan | 222/603 |
| 2094454 | 9/1982 | United Kingdom | 266/236 |
| 0822990 | 4/1981 | U.S.S.R. | 222/603 |
| 0899275 | 1/1982 | U.S.S.R. | 222/606 |

*Primary Examiner*—L. Dewayne Rutledge
*Assistant Examiner*—S. Kastler
*Attorney, Agent, or Firm*—Wenderoth, Lind & Ponack

[57] ABSTRACT

An apparatus for shielding from the surrounding air a stream of molten metal being discharged from a discharge sleeve of a metallurgical vessel includes a tuyere-like adapter device mounted about the discharge sleeve. The tuyere-like adapter device is supplied with a pressurized inert gas and is constructed to produce a hollow jet of inert gas having a maximum length of approximately 20 cm as a gaseous shield surrounding a molten metal stream discharged from the discharge sleeve.

11 Claims, 3 Drawing Figures

APPARATUS FOR SHIELDING A MOLTEN METAL STREAM

BACKGROUND OF THE INVENTION

The present invention relates to an apparatus for shielding from the surrounding air a stream of molten metal being discharged from a discharge sleeve of a metallurgical vessel, particularly during the teeming of steel from a pouring ladle during an ingot casting operation.

It is known that problems arise frequently when attempting to prevent air from contacting and rejoining a discharge stream of molten steel, previously degassed by a vacuum treatment operation, and thereby to prevent nitrogen or oxygen from being again absorbed by such steel. Particularly when the molten stream is teemed in an ingot casting operation, i.e. into geometrically simple bodies in permanent molds, nothing prevents the molten steel, during its free fall from the pouring ladle into the sprue of the molds, from absorbing nitrogen, for example to an undesirably high content. A free air space between the ladle lip and the sprue, in the case of group teeming, or the mold in the case of a top pouring operation, cannot be avoided even if the ladle is placed with a high degree of precision into the pouring position. The height of such free air space may be as much as 80 to 150 mm.

SUMMARY OF THE INVENTION

With the above discussion in mind, it is an object of the present invention to provide an apparatus for shielding from the surrounding air a stream of molten metal discharged from a discharge sleeve of a metallurgical vessel, whereby it is possible to avoid the above and other prior art disadvantages.

It is a further object of the present invention to provide such an apparatus which may be readily assembled to and integrated into existing metallurgical vessel structures of various types.

It is a still further object of the present invention to provide such an apparatus which forms a hollow inert gas shield around the stream of molten metal, thereby protecting the stream from the entry of harmful air, and also which enables the molten metal, for example steel, to be rinsed or cleaned.

These objects are achieved in accordance with the present invention by an apparatus in the form of a tuyere-like adapter device to be mounted about a discharge sleeve of a metallurgical vessel. The adapter device includes means for producing a hollow jet of inert gas as a gaseous shield surrounding a molten metal stream discharged from the discharge sleeve. The hollow jet of inert gas has a maximum length or height of 20 cm. By this structural arrangement, no outside air has access to the stream of molten metal. Thus, molten steel no longer will reabsorb nitrogen, and the nitrogen content of the steel thus can be held within necessary and desired limits. Additionally, it is easy to adjust the shape and velocity of the jet of inert gas in such a manner that the rinsing or cleaning of the molten steel can be achieved at the stream and, for example, at the bath level of the sprue receiving the mass of molten steel. The apparatus can be installed without difficulty and can be replaced together with the discharge sleeve. Thus, the discharge sleeve can be considered a cooperating part of the apparatus of the invention.

The adapter device includes an annular refractory sleeve adapted to surround the discharge sleeve with an annular tuyere gap therebetween. The annular refractory sleeve includes a gas collecting chamber, for example in the form of an outer annular groove or recess. An outer inlet supplies pressurized gas to the collecting chamber, and radial channels discharge the gas from the collecting chamber to the tuyere gap to form therein the hollow jet.

In one arrangement of the present invention, the discharge sleeve has an outer circumferential wall defining one surface of the tuyere gap. This results in an apparatus of relatively simple structure, the more so if the discharge tube has an outer metal jacket defining at least partially the tuyere gap. Further preferably, the annular refractory sleeve includes an inner annular metal jacket adapted to fit around the discharge sleeve. In one arrangement of the present invention, the discharge sleeve has a lower conical portion, and the inner metal jacket of the annular refractory sleeve includes a conical portion diverging downwardly and inwardly away from the annular refractory sleeve and adapted to contact the lower conical portion of the discharge sleeve. A portion of the tuyere gap thus is defined between the annular refractory sleeve and the conical portion of the inner metal jacket thereof. At least a portion of the tuyere gap may have a gas permeable refractory insert, thereby providing protection against obstruction of the tuyere gap.

In accordance with a further arrangement of the present invention, the gas collecting chamber is in the form of an annular recess formed in the outer surface of the annular refractory sleeve, and an outer annular metal jacket covers such recess. A pressurized gas connection extends through the outer metal jacket to the annular recess. This structural arrangement provides an easily formed apparatus.

In accordance with a further feature of the present invention, the structure for supplying the gas from the collecting chamber to the tuyere gap is in the form of a plurality of holes extending radially through the annular refractory sleeve from the annular recess to the tuyere gap. Such holes may be circumferentially spaced around the annular refractory sleeve and may be arranged in one or more planes or annular groupings. Preferably, there are provided 12 to 40 such holes, each having a diameter of 0.4 to 1.2 mm. Such holes are distributed uniformly around the annular refractory sleeve.

Under certain local conditions of the area of a ladle lip, it is of advantage to mount the adapter device of the invention on a shield of a slide gate nozzle, for example such an arrangement including the discharge sleeve. However, if no shield is provided in the particular metallurgical vessel structure, it is of advantage to provide means for mounting the adapter device about the discharge sleeve itself. A particular arrangement involves clip-type connector devices formed between an inner metal jacket of the refractory annular sleeve and a metal jacket of the discharge sleeve. Various known clip-type connecting arrangements may be provided, for example by clip threads or like structures.

BRIEF DESCRIPTION OF THE DRAWINGS

Other objects, features and advantages of the present invention will be apparent from the following detailed description of various embodiments thereof, with reference to the accompanying drawings, wherein.

DETAILED DESCRIPTION OF THE INVENTION

Figure 1:
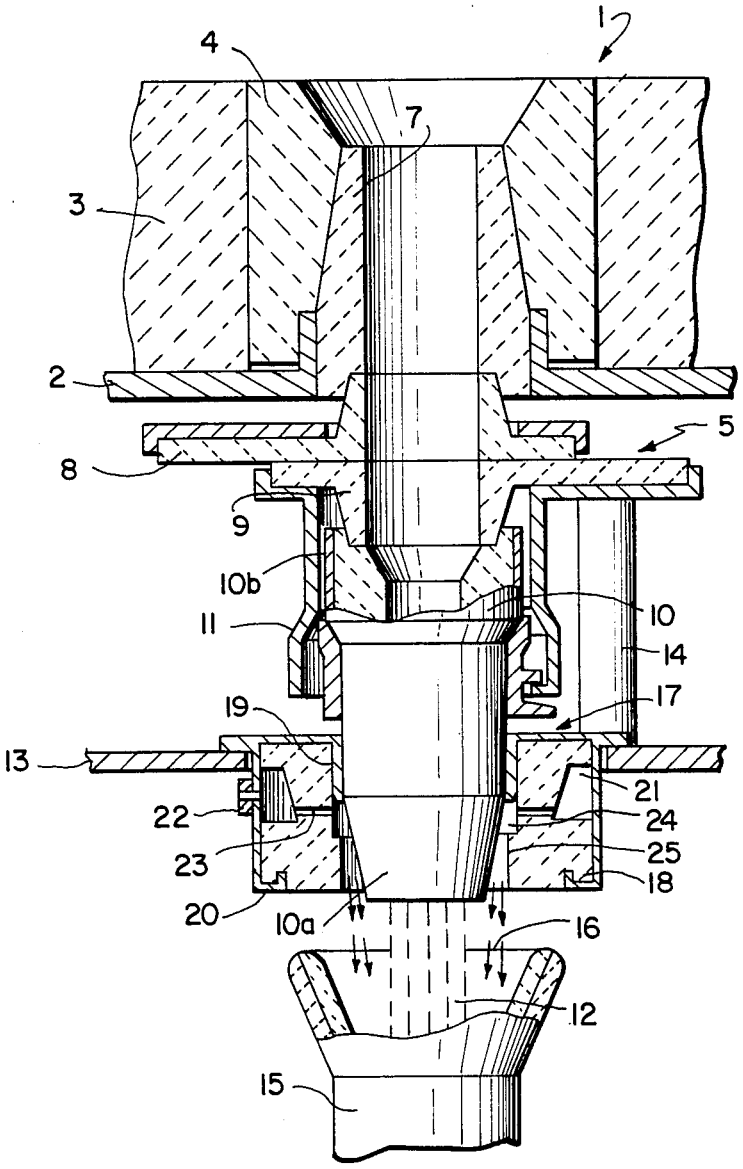
FIG. 1 is a longitudinal sectional view through a pouring ladle equipped with a slide gate nozzle and including one embodiment of the apparatus of the present invention.

In FIG. 1 there is shown a portion of the bottom of a pouring ladle 1 for discharging therefrom a stream of molten steel and including a metal jacket 2, a refractory lining 3, a perforated discharge brick 4 and an outlet sleeve 7. The illustrated ladle has mounted at sleeve 7 a slide gate nozzle arrangement including a stationary refractory plate 8, a sliding refractory plate 9 mounted in a supporting frame 11, and a discharge sleeve 10 fitted to sliding refractory plate 9 and movable therewith, for starting, stopping and controlling a discharge stream 12 of molten metal. Discharge sleeve 10 includes a conical bottom outlet portion 10*a* and a metal jacket 10*b* and is replaceably coupled with supporting frame 11, for example by a bayonet coupling, to extend through a shield 13 also carried by frame 11 by means of braces 14.

The pouring ladle 1 is conveyed by a crane and is directed into a pouring position above a molten metal receiving member such as sprue 15. With slide gate nozzle apparatus moved to the open position, stream 12 is discharged into sprue 15 to thereby fill a plurality of molds, not shown. A free space, which of necessity has a maximum height of approximately 20 cm, remains between the discharge end of discharge sleeve 10 and sprue 15. The apparatus of the present invention provides an inert gaseous shield 16 in this free space to protect the stream 12 from the surrounding air.

The gaseous shield 16 is produced by a tuyere-like adapter device 17 which is mounted in a gas tight manner about the free end of discharge tube 10 and which is supported, for example by a hook, on shield 13. Adapter device 17 includes an annular refractory sleeve 18 having an inner metal jacket 19 and an outer metal jacket 20, the latter also serving as a suspension device. Sleeve 18 has formed in the outer periphery thereof an annular gas collecting chamber, for example formed by an annular groove or recess 21 which is covered by outer metal jacket 20. A pressurized gas inlet connection 22 extends through outer jacket 20 to supply pressurized inert gas to collecting chamber 21.

Between the conical lower end 10*a* of discharge sleeve 10 and the inner annular surface of adapter device 17 is defined an annular tuyere gap 24. A plurality of radial channels or holes 23 supply pressurized gas from chamber 21 to tuyere gap 24, thereby forming hollow jet 16 which surrounds and shields the stream 12.

When the gas collecting chamber 21 is charged with inert gas, the pressurized gas is distributed uniformly around the circumference through radial channels 23 to the tuyere gap 24, from which flows a hollow gas stream surrounding the stream 12 and in the form of shield 16. The conversion of the pressure of the gas occurs mainly at a projection 25, of reduced inner diameter, of the inner annular surface of sleeve 18.

The holes 23 are spaced circumferentially. Preferably, from 12 to 40 holes 23 are provided, each having a diameter of 0.4 to 1.2 mm.

Figure 3:
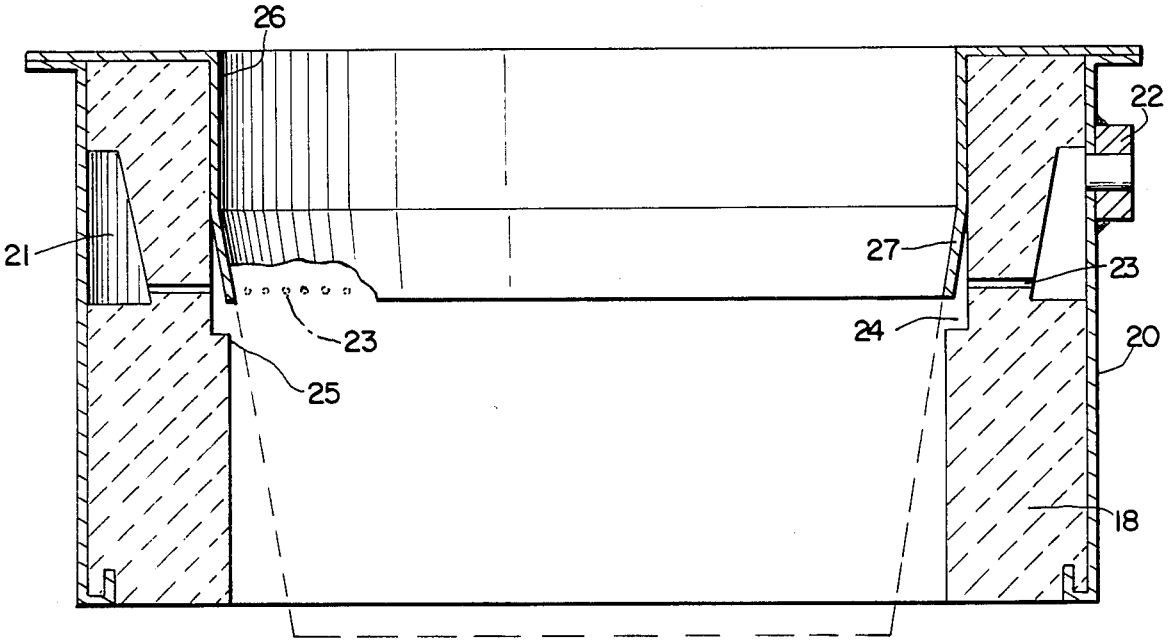
FIG. 3 is an enlarged cross sectional view of a modified apparatus according to the present invention.

FIG. 3 illustrates a modification of the embodiment of FIG. 1. Thus, inner metal jacket 26 has an inner conical portion 27 diverging downwardly and inwardly away from annular refractory sleeve 18 at a location to face holes 23 and to define a portion of the tuyere gap 24. Even further, conical portion 27 could be extended further downwardly to face projection 25, such that the entire tuyere gap 24 is defined by portion 27, without utilization of the discharge sleeve 10.

Figure 2:
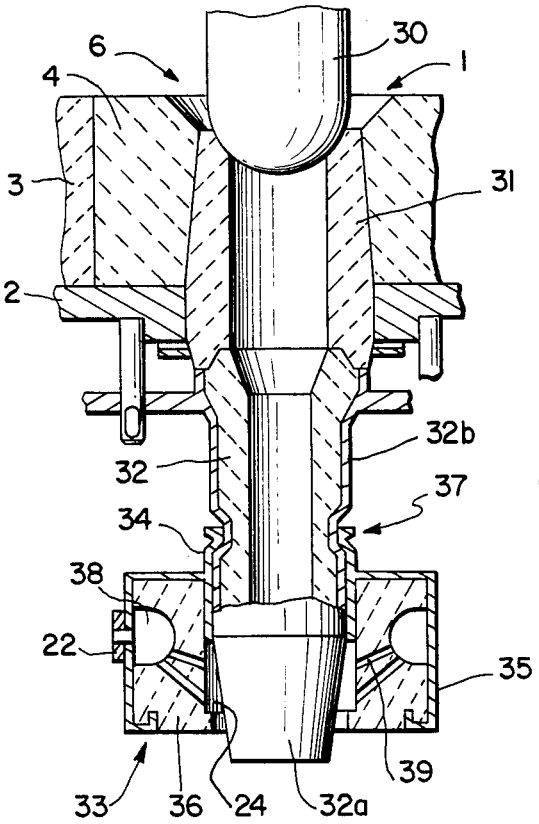
FIG. 2 is a view similar to FIG. 1, but of a ladle equipped with a stopper rod and an apparatus according to another embodiment of the present invention.

FIG. 2 illustrates a further embodiment of the present invention. Thus, a stopper rod arrangement 6 includes a stopper 30 adapted to seat against and seal an opening through a perforated sleeve 31. A discharge sleeve 32 is mounted directly to perforated sleeve 31, and there is not provided the slide gate nozzle arrangement of FIG. 1. The discharge sleeve 32 includes a lower conical portion 32*a* and an outer metal jacket 32*b*. A tuyere-like adapter device 33 is mounted on the jacket 32*b* of discharge sleeve 32 by means of a clip closure arrangement 37 formed between metal jacket 32*b* and an inner metal jacket 34 of an annular refractory sleeve 36 of the adapter device. The device further includes an outer metal jacket 35 covering a gas collecting chamber 38 defined by a groove having a semi-circular shape. Two rows of radial channels or holes 39 extend between collecting chamber 38 and tuyere gap 24. It will be apparent that this embodiment of the invention operates substantially similarly to the embodiment of FIG. 1.

In principle, the channel connection could be replaced by a corresponding narrow slit, for example by joining together two halves of a two-part refractory annular sleeve. The tuyere-like adapter device particularly can be employed in rotary valve closure devices having two discharge sleeves, one of which is employed for normal pouring operations, while the other of which is equipped with the adapter device of the invention for the casting of materials to be isolated and protected from the exterior air. Needless to say, with appropriate design and capacity, the apparatus can be employed effectively in top casting operations.

Although the present invention has been described and illustrated with respect to preferred features thereof, it will be apparent that various changes and modifications may be made to the specifically described and illustrated features without departing from the scope of the present invention.

I claim:

1. In an apparatus for discharging molten metal from a metallurgical vessel, said apparatus being of the type including a refractory discharge sleeve having an outlet end located above an inlet end of a molten metal receiving member with a space therebetween, the improvement comprising means for shielding from the surrounding air a stream of molten metal during passage thereof through said space between said outlet end of said discharge sleeve and said inlet end of said receiving member, said shielding means comprising:

an annular refractory sleeve surrounding said discharge sleeve and positioned above and spaced from said receiving member;

said refractory sleeve and said discharge sleeve defining therebetween an annular, downwardly directed gap;

said refractory sleeve having a gas collection chamber;

outer inlet means for supplying pressurized inert gas to said gas collection chamber; and means for supplying said inert gas from said gas collection chamber into said annular gap and thereby for producing a downwardly directed hollow jet of inert gas having a maximum length of approximately 20 cm as a gaseous shield in said space surrounding a molten metal stream discharged from said outlet end of said discharge sleeve.

2. The improvement claimed in claim 1, wherein said annular refractory sleeve includes an inner annular metal jacket fitted around said discharge sleeve.

3. The improvement claimed in claim 2, wherein said discharge sleeve has a lower conical portion defining said outlet end, and said inner metal jacket includes a conical portion diverging downwardly and inwardly away from said annular refractory sleeve and contacting said lower conical portion of said discharge sleeve, a portion of said annular gap being defined between said annular refractory sleeve and said conical portion of said inner metal jacket.

4. The improvement claimed in claim 3, further comprising a gas permeable refractory insert in said annular gap.

5. The improvement claimed in claim 1, wherein said gas collecting chamber comprises an annular recess formed in said annular refractory sleeve, and an outer annular metal jacket covering said recess.

6. The improvement claimed in claim 5, wherein said outer inlet means comprises a pressurized gas connection for supplying said inert gas through said outer metal jacket to said recess.

7. The improvement claimed in claim 5, wherein said supplying means comprises a plurality of holes extending through said annular refractory sleeve from said recess to said annular gap.

8. The improvement claimed in claim 7, wherein said holes are spaced circumferentially around said annular refractory sleeve and are arranged in at least one plane.

9. The improvement claimed in claim 8, comprising 12 to 40 said holes each having a diameter of 0.4 to 1.2 mm.

10. The improvement claimed in claim 1, further comprising means for mounting said refractory sleeve on a shield of a slide gate nozzle including said discharge sleeve.

11. The improvement claimed in claim 1, further comprising connecting means for mounting said annular sleeve about said discharge sleeve.

* * * * *